US006094549A

United States Patent [19]

Hiraoka et al.

[11] Patent Number: 6,094,549

[45] Date of Patent: Jul. 25, 2000

[54] ELECTROGRAPH APPARATUS ENABLING REMOVAL OF OFFENSIVE SUBSTANCES

[75] Inventors: Chikara Hiraoka, Chiyoda-machi; Katsumi Kumada, Kitaibaraki; Katsuyoshi Onose, Hitachi, all of Japan

[73] Assignee: Hitachi, Ltd., Tokyo, Japan

[21] Appl. No.: 09/159,785

[22] Filed: Sep. 24, 1998

[30] Foreign Application Priority Data

Sep. 26, 1997 [JP] Japan ..... 9-261975

[51] Int. Cl.[7] ..... G03G 21/00; G03G 15/20

[52] U.S. Cl. ..... 399/93; 399/325

[58] Field of Search ..... 399/92, 93, 324, 399/325, 91, 320

[56] References Cited

U.S. PATENT DOCUMENTS

| | | | |
|---|---|---|---|
| 4,202,618 | 5/1980 | Waschk et al. | 399/93 |
| 4,693,588 | 9/1987 | Yarbrough et al. | 399/93 |
| 5,155,531 | 10/1992 | Kurotori et al. | 399/325 X |
| 5,164,778 | 11/1992 | Tanabe et al. | 399/93 X |
| 5,471,280 | 11/1995 | Taguchi | 399/93 X |
| 5,550,621 | 8/1996 | Ogawahara | 399/92 X |
| 5,897,244 | 4/1999 | Miyazaki et al. | 399/325 X |

FOREIGN PATENT DOCUMENTS

| | | |
|---|---|---|
| 57-8557 | 1/1982 | Japan . |
| 59-4699 | 1/1984 | Japan . |
| 64-6463 | 2/1989 | Japan . |
| 7-20752 | 1/1995 | Japan . |

*Primary Examiner*—Susan S. Y. Lee

*Attorney, Agent, or Firm*—Antonelli, Terry, Stout & Kraus, LLP

[57] ABSTRACT

An electrograph apparatus includes a photoconductor, a charging device for uniformly charging the surface of the photoconductor, a developing device, a charge extinguishing device functioning so that a sheet of printed paper can be easily released, and a fixing device in which denatured silicone oil having a mercapto-group as a functional group is used as a releasing agent, for fixing a toner image copied on a printing paper, in which the fixing device is provided above the charging device and the charge extinguishing device. Further, a deodorizing device having a suction fan and a catalyst filter, at least the surface of which has a catalyst of metal oxide, is provided above the fixing device, the deodorizing device promoting reaction of ozone generated at the charging device and the charge extinguishing device with offensive substances containing mercaptan and further decomposing the ozone and the offensive substances, wherein exhaust gas containing the decomposed ozone and offensive substances is expelled in a direction opposite to the direction of the arrangement of the photoconductor and the developing device.

11 Claims, 2 Drawing Sheets

ELECTROGRAPH APPARATUS ENABLING REMOVAL OF OFFENSIVE SUBSTANCES

BACKGROUND OF THE INVENTION

The present invention relates to an image printing apparatus, such as a copying machine, a printer, and so forth, in which the electrography is employed.

Conventionally, in a thermal fixing device of the type used for a color printer or a color copying machine, the following thermal fixing method has been widely used. The machine is provided with a paper contacting part composed of two rollers, one of which is a heating roller and the surface of each of which is covered with layers of elastic material, and a non-fixed toner image carried on a sheet of printing paper is fixed by heat applied to the sheet of printing paper from the heating roller while the printing paper is grasped and transported between the two rollers. This fixing method tends to cause a problem in that some of the toner is melted by the heat from the heating roller, and a pert of the melted toner is separated from the toner image and adheres to the heating roller, resulting in what is called an offset phenomena, and the offset toner adhering to the heating roller is transferred to the pressing roller or another sheet of printing paper, so as to contaminate the surface of the pressing roller or the printing paper.

Therefore, the releasability of toner from the surface of the heating roller has been secured by applying a releasing agent to the surface of the heating roller.

Now, as a releasing agent to secure the releasability of the toner from the surface of the heating roller, various kinds of silicone oil have been used corresponding to the material used for the heating surface. For example, dimethyl silicone oil and mercapto-denatured silicone oil, including the mercapto-group as a functional group, which is disclosed in Japanese Patent Publications 41699/1984 and 6463/1989, have been applied on surface materials of silicone rubber and fluororubber, respectively.

However, if silicone rubber is used for the surface material of the heating roller and dimethyl silicone oil is used as a releasing agent in the fixing device, although a satisfactory releasability of the toner from the surface of the heating roller can be obtained with a uniformly formed oil film in the beginning, the oil film becomes nonuniform over time because the surface of the heating roller gradually becomes rough as many sheets of printing paper pass between the two rollers. As a result, the releasability of the toner from the surface of the heating roller degrades rapidly, and the offset phenomena or the winding of a sheet of printing paper around the heating roller occurs.

On the other hand, if mercapto-denatured silicone oil is used as a releasing agent, a strong oil film is formed by the action of the mercapto-group, in which the mercapto-group causes ionic-bonding with fillers of metal oxide contained in the rubber surface of the heating roller, even though the surface of the heating roller becomes rough after passing a large number of sheets of printing paper between the two rollers. Therefore, it is possible to maintain the releasability for a long time. However, the mercapto-group volatilizes as methyl-mercaptan ($CH_3SH$), as a result of long time heating of the rubber surface, and an odor of mercaptan is generated.

Conventionally, generation of the odor has been reduced by using oil in which the mercapto-group is decreased to as low a level as possible.

As a method of deodorizing odor generated from not only mercapto-denatured silicone oil, but also from toner or the printing papers, which is caused by the heat generated during the fixing operations, Japanese Patent Application Laid-Open 20752/1995 discloses a method of expelling odors by using a fan and a duct provided above the fixing device, and Japanese Patent Application Laid-Open 8557/1985 also discloses a method of decomposing offensive substances by using an oxide catalyst formed in a honeycomb shape in which a catalyst of alumina-$Mn_2O_3$—ZnO, alumina-$Mn_2O_3$—$Fe_2O_3$, and so forth are used.

However, reducing the amount of the mercapto-group brings about a lowering of the ionic-bond action of the mercapto-group, in which the mercapto-group causes ionic-bonding with fillers of metal oxide contained in the rubber surface of a heating roller. Consequently, the oil film gradually becomes non-uniform and the releasability in the surface of the heating roller degrades, as the surface of the heating roller becomes rough after passing many sheets of printing paper between the two rollers. Therefore, even if mercapto-denatured silicone oil is used, it has been difficult to greatly extend the life of the fixing device.

Moreover, the above deodorizing methods disclosed in Japanese Patent Application Laid-Open 20752/1995 and Japanese Patent Application Laid-Open 8557/1985 can not decompose the odor of methyl-mercaptan enough, and so it is necessary to increase the surface area of the oxide catalyst element or to gain more time for decomposing the offensive substances by decreasing the speed of the exhaust gas passing through the oxide catalyst. However, the above-mentioned countermeasures cause an increase in the size of an electrograph apparatus or an increase in the temperature in the apparatus, which is due to the heat generated in the fixing device.

SUMMARY OF THE INVENTION

The present invention has been devised in consideration of the above-mentioned problems, and has the objective of extending the life of a fixing device by reducing offensive substances volatilizing from mercapto-denatured silicone oil without degrading the high releasability afforded by the mercapto-denatured silicone oil.

The first feature of the present invention, which is designed to attain the above object, is to provide an electrograph apparatus including a photoconductor, a charging device for uniformly charging the surface of the photoconductor, a developing device, a charge extinguishing device functioning so that a printed sheet of paper can be easily released, and a fixing device in which denatured silicone oil having the mercapto-group as a functional group is used as a releasing agent, for fixing a toner image copied on a sheet of printing paper.

In this apparatus, the fixing device is provided above the charging device and the charge extinguishing device, and a deodorizing means in the form of a suction fan and a catalyst filter, at least the surface of which having a catalyst of metal oxide, is provided above the fixing device, the deodorizing means promoting reaction of ozone generated at the charging device and the charge extinguishing device with offensive substances containing mercaptan and further decomposing the ozone and the offensive substances, wherein exhaust gas, containing the decomposed ozone and offensive substances is expelled in a direction opposite to the direction of the arrangement of the photoconductor and the developing device.

The second feature of the present invention resides in the fact that, in the above electrograph apparatus, the flow path of gas to be expelled is provided in a route from the charging device, to the charge extinguishing device, to the fixing device and then to the deodorizing means.

The third feature of the present invention resides in the fact that, in the above electrograph apparatus, the pressure loss at the catalyst filter during ventilation of the exhaust gas is substantially less than 0.5 mmAq.

The fourth feature of the present invention resides in the fact that, in the above electrograph apparatus, the catalyst filter is a honeycomb filter having cells of 100–300 per 1 $inch^2$ with respect to the cross section of the filter.

The fifth feature of the present invention resides in the fact that, in the above electrograph apparatus, the flowrate of the exhaust gas in said catalyst filter is such that the temperature in the vicinity of the surfaces of the photoconductor and the developing device is lower than the glass transition temperature of toner which is used in the electrograph apparatus.

The sixth feature of the present invention resides in the fact that, in the above electrograph apparatus, the flowrate of the exhaust gas in the catalyst filter is substantially more than $3\times10^{-3}$ $m^3/s$.

The seventh feature of the present invention is resides in the fact that, in the above electrograph apparatus, ozone is generated by operating the charging device and the charge extinguishing device periodically and also in a stand-by state in which the electrograph function is not performed, and the deodorizing means decomposes both the generated and the remaining offensive substances containing mercaptan, by promoting a reaction between the generated ozone with the remaining offensive substances containing mercaptan.

The eighth feature of the present invention resides in the fact that, in the above electrograph apparatus, a baffle plate is provided between the fixing device and the deodorizing means to prevent the fixing device from being over-cooled to a temperature lower than a proper temperature, by causing the exhaust gas to flow in routes along both sides of the fixing device.

DETAILED DESCRIPTION OF THE EMBODIMENTS

Hereinafter, various embodiments of the invention will be explained in detail with reference to the drawings.

Figure 1:
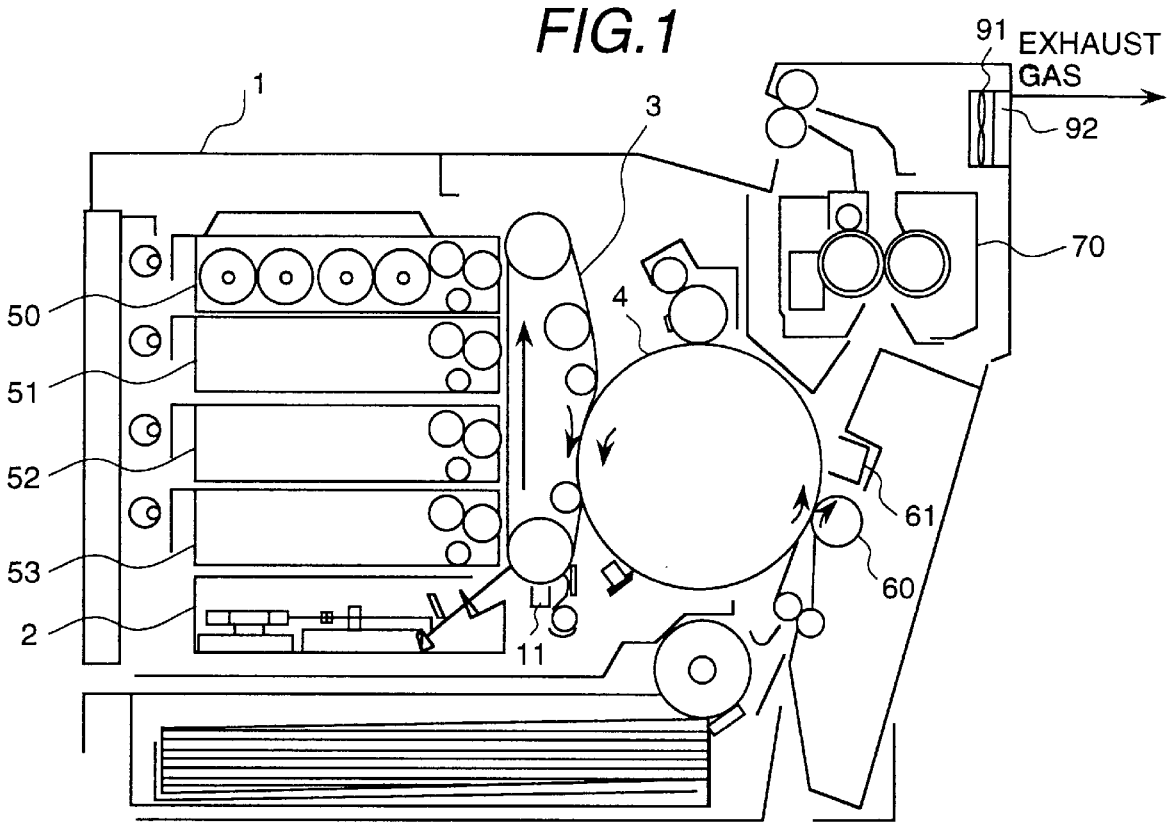
FIG. 1 is a diagrammatic side cross section showing the composition of an electrograph apparatus an embodiment according to the present invention.

FIG. 1 shows the composition of a color laser printer 1 representing an embodiment according to the present invention.

The color laser printer 1 has a belt type photoconductor 3 wound around a plurality of pulleys, a copying drum 4 arranged so as to contact a part of the photoconductor 3, a charging device 11 for uniformly charging the surface of the photoconductor 3, an exposing device 2 for forming an electrostatic latent image on the surface of the photoconductor 3 by exposing the surface of the uniformly charged photoconductor 3, four developing devices 50, 51, 52, and 53 for forming a color toner image by developing the electrostatic latent image, a copying roller 60 for copying the toner image on a sheet of printing paper, a charge extinguishing device 61 functioning so that a sheet of printed paper can be easily released from the copying drum 4, and a fixing device 70 for fixing the toner image copied on the sheet of printing paper, in which denatured silicone oil, including the mercapto-group as a functional group, is used as a releasing agent. Moreover, the fixing device 70 is provided above the charging device 11 and the charge extinguishing device 61.

Figure 2:
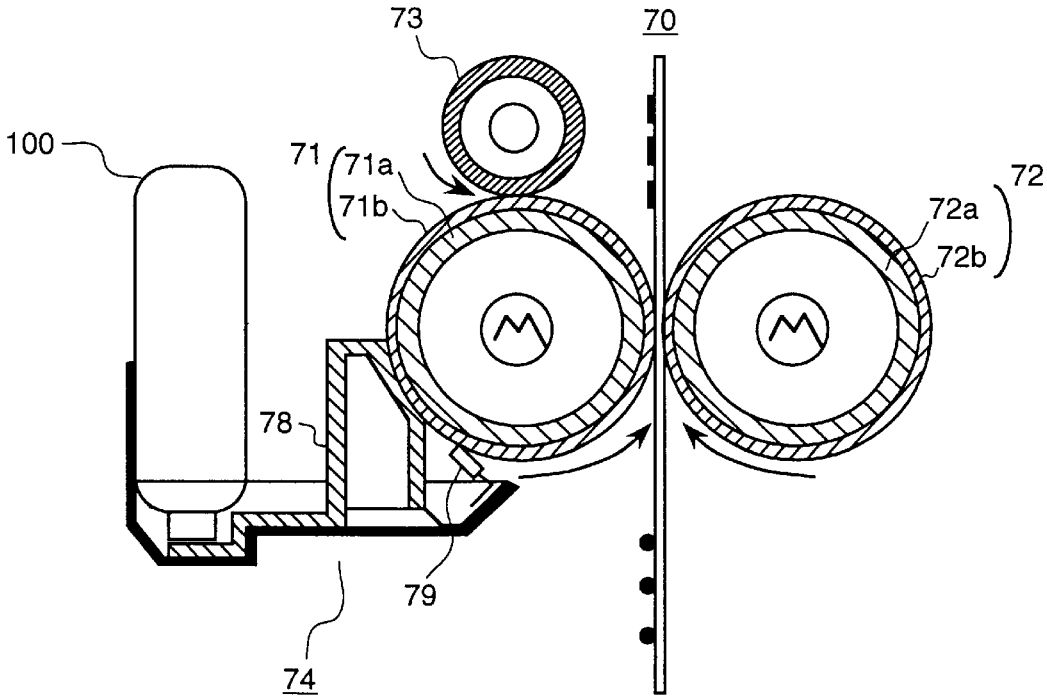
FIG. 2 is a side cross section showing the composition of a fixing device of the embodiment.

FIG. 2 is a side cross section showing the composition of the fixing device 70.

A heating roller 71 and a pressing roller 72 have elastic surfaces, and include metal pipe cores 71*a* and 72*a* covered with silicone rubber sheets 71*b* and 72*b* of JIS hardness 40, having a thickness of 1.5 mm, respectively.

Furthermore, an oil applying unit 74 for stably applying silicone oil on the surface of the heating roller 71 and a leaning roller 73 for removing offset toner adhering to the surface of the heating roller 71 are provided near the heating roller 71.

The heaters 75 and 76 are serially connected, and the generation of heat in the heaters is controlled so as to keep the temperature at the surface of the heating roller 71 at approximately 140° C.

The oil applying unit 74 includes an oil tank 100, an oil feeding felt unit 78 for feeding oil stored in the oil tank 74 to the heating roller 71 by making use of capillary action, and an oil blade 79 for setting the amount of oil to be carried by the roller 71 at a predetermined amount, so that an oil film is formed on the surface of the heating roller 71 as it rotates in the direction of the arrow shown in FIG. 2.

In the oil tank 100, there is a mixture of mercapto-denatured silicone oil expressed by the following general chemical formula (I) and dimethyl silicone oil, the viscosity of which is 10–1000 cSt, preferably 50–500 cSt, at a temperature of 25° C.

(I)

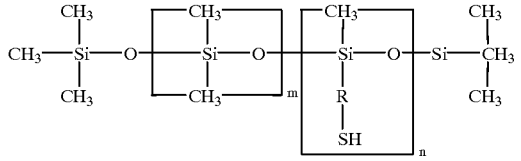

where R indicates the alkylene group whose carbon number is 1 to 8, and m and n are positive integers.

Mercapto-denatured silicone oil can form a stronger film than dimethyl silicone oil because mercapto-denatured silicone oil takes part in an ion-bonding reaction with a metal oxide by the action of the mercapto-group (—SH), which is contained in the rubber surface as a filler. On the other hand, using mercapto-denatured silicone oil causes a problem in that the mercapto-group volatilizes as methyl-mercaptan (CH3—SH) due to the heat generated during use over a long period pf time, and an odor of mercaptan is generated.

In accordance with the present invention, in order to solve the above problem, the fan 91 and the catalyst filter 92, which makes use of active oxygen, are provided above the fixing device 70, as shown in FIG. 1, and volatile components generated at the fixing device 70 react with ozone generated at the charging device 11 and the charge extinguishing device 61. The remaining volatile components and ozone are further completely decomposed in the catalyst filter 92 and are expelled as exhaust gas from the electrograph apparatus. The direction in which the exhaust gas is expelled is opposite to the direction of the arrangement of the photoconductor 3 and the developing devices 50, 51, 52, and 53, that is, it is opposite to the direction from the photoconductor 3 towards the developing devices 50, 51, 52, and 53. By the exhaust gas in this expelling direction, siloxane of low molecular weight in the silicone oil is prevented from adhering to those devices.

Figure 3:
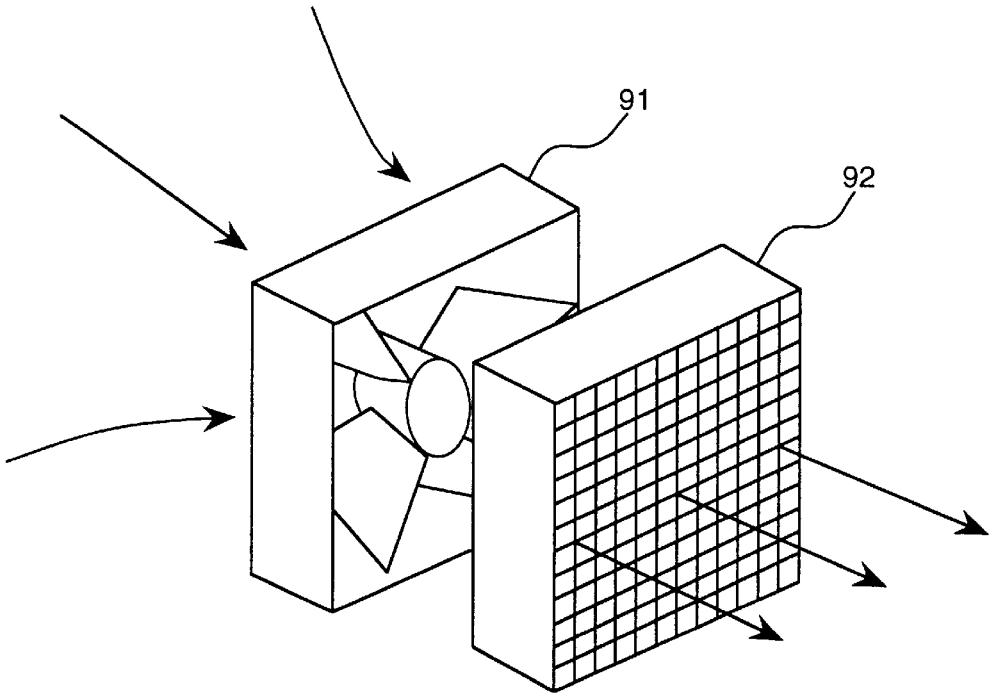
FIG. 3 is a perspective view of a deodorizing means of the embodiment.

FIG. 3 is a perspective view showing the composition of a deodorizing system composed of the fan 91 and the catalyst filter 92. The catalyst filter 92 has the structure of a honeycomb having a depth (the length in the gas flow direction) of 10 mm, and the size of its cross section of 60 mm×60 mm. The filter 92 is made of a deodorizing ceramic catalyst including a metal oxide catalyst, such as $MnO_2$ and so on. However, the structure of the catalyst filter 92 is not restricted to a honeycomb structure, and a catalyst filter of any structure, for example, an unwoven fabric catalyst filter, is applicable so long as the structure can secure a gas permeability sufficient to allow air or gas to smoothly pass through the filter to the outside of the electrograph apparatus without causing a stagnation of gas flow in the apparatus. The gas 12 permeability of a filter can be expressed by the pressure loss of fluid passing through the filter, and it was found by the inventors that any filter having a gas permeability of less than 0.5 mmAq can be practically used. Moreover, although a porous catalyst including $MnO_2$ as a main component, which has a high ratio of fluid contact area to unit volume and a comparatively high decomposition ability, is used in this embodiment, a metal oxide catalyst of NiO, $Fe_2O_3$, $TiO_2$, ZnO, etc. is also applicable. Furthermore, if a metal oxide catalyst is contained in at least a surface layer of the filter, the filter functions effectively, because the generated ozone and offensive component of methyl-mercaptan are decomposed into dimethyl-sulfide and water by the reaction mainly caused at the surface, as expressed in the following chemical formula (II), when they contact the metal oxide catalyst of the catalyst filter 92.

$$2CH_3SH+\rightarrow(CH_3)_2S_2+H_2O \quad \text{(II)}$$

Although the oxygen on the left side of the formula (II) is supplied from oxygen in the air by the action of the metal oxide, this reaction can be enhanced by the generated and sucked ozone which is highly active oxygen. Therefore, by operating the charging device 11 and the charge extinguishing device 61 periodically and also during a stand-by state in which the electrograph function is not performed, it is possible to more efficiently decompose mercaptan volatilizing from the mercapto-denatured silicone oil heated by the fixing device 70.

In the decomposition reaction in the catalyst filter, the larger number and the narrower sectional area of cells which make up the filter raise the degree of the decomposition reaction because the larger contact area and the longer contact time of the gas and the catalyst enhance the performance of the decomposing ozone or offensive substances emitted from the oil. On the other hand, the increase in the number of cells causes a decrease in the flowrate of air passed by the suction fan 91 through the filter. Consequently, the temperature in the electrograph apparatus is increased by the heat generated in the fixing device 70, and this increase in temperature exerts a bad influence on the fluid characteristics of toner at the developing devices 50–53, and on the performance of the photoconductor 3 and the copying drum 4. Generally, it is necessary to maintain the temperature in the vicinity of the developing devices 50–53, and the photoconductor 3 and the copying drum 4, below the glass transition temperature of the toner. Thus, it is desirable to use a catalyst filter of 100–300 cells per 1 $inch^2$ to allow gas to smoothly pass through the filter to the outside of the electrograph apparatus without causing a stagnation of the gas flow in the apparatus 14 and to sufficiently decompose offensive substances from the oil. In this embodiment, by using a catalyst filter of 210 cells per 1 $inch^2$, the necessary suction flowrate of the exhaust gas expelled by the fan 91 is secured, and the temperature in the vicinity of the developing devices 50–53 and the photoconductor 3 is maintained at about 50° C.

Figure 4:
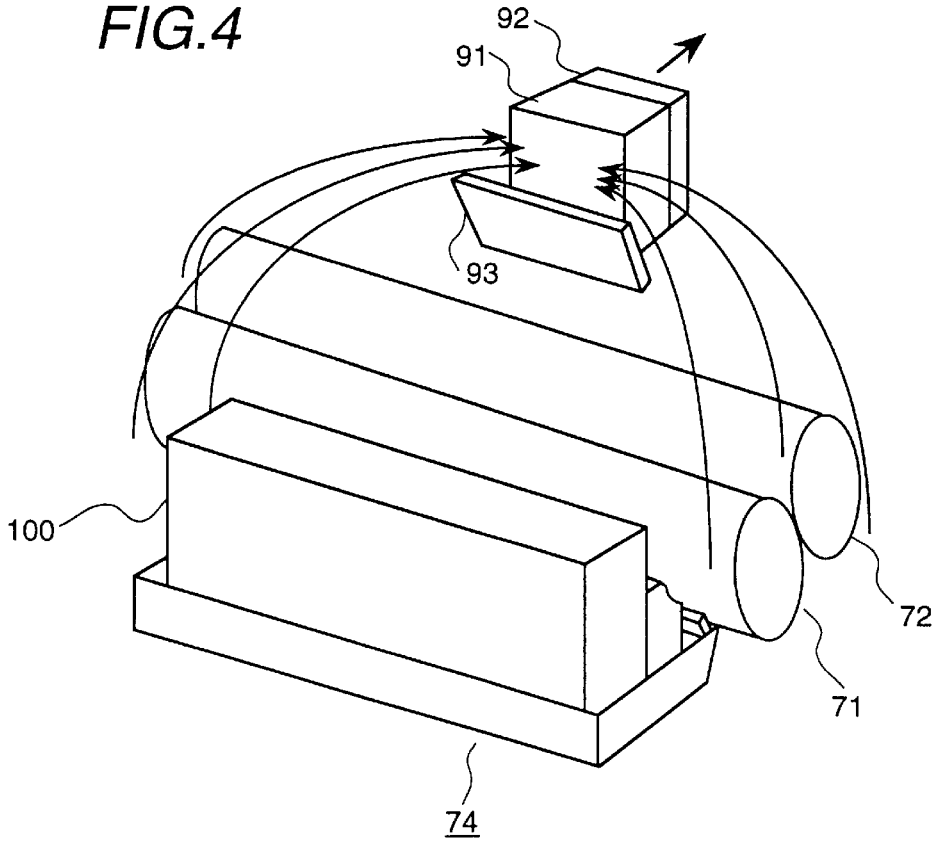
FIG. 4 is a perspective view of a deodorizing means representing another embodiment according to the present invention.

FIG. 4 is a perspective view showing the arrangement of the fixing device 70 and the deodorizing means of another embodiment.

In this embodiment, a baffle plate 93 is provided between the deodorizing means and the fixing device 70 to prevent the heating roller 71 and the pressing roller 72 from being over-cooled by the suction fan 91. By this arrangement, the air or gas to be expelled flows along routes at both sides of the rollers 71 and 72 into the deodorizing means, as shown by the arrows in FIG. 4. Thus, an increase in the temperature at the end parts of the two rollers 71 and 72 can be prevented, and even if the flowrate of exhaust gas is increased by the suction fan 91 to increase the deodorizing efficiency or the efficiency of cooling the air in the electrograph apparatus, it is possible to prevent the heating roller 71 and the pressing roller 72 from being over-cooled. The reason why the end parts of the rollers 71 and 72 are mainly cooled is that, because the length of the two rollers 71 and 72 are longer than the width of a sheet of printing paper, the temperature at the 15 end parts of the rollers 71 and 72, on which a sheet of printing paper is not conveyed, is increased during a continues printing operation, and the temperature in the electrograph apparatus is increased by the heat transfer from the ends of the heating roller 71 and the pressing rollers 72.

In the following, the results of a test for estimating the effects of the above-mentioned deodorizing means will be explained.

In the test, the level of odors outside an electrograph apparatus having a catalyst filter and an electrograph apparatus not having a catalyst filter were compared when using denatured oil whose mercapto-group equivalent (the ratio of the total molecular weight of the silicone oil to the number of the mercapto-group) is 30000–3000000. During a continuous printing operation, at each set level of the mercapto-group equivalent, five testing persons spiffed the air to detect an odor of mercaptan contained in exhaust gas expelled to the outside of an electrograph apparatus, and they estimated the extent of the odor using a five grade estimation method.

Furthermore, to evaluate effects of the mercapto-group on the releasability of printing papers, a non-offset band (the temperature range of a fixing device, in which the offset toner phenomena does not occur) in using the catalyst filter and a non-offset band in not using the catalyst filter was compared at each set level of the mercapto-group equivalent.

The mercapto-group equivalent of the oil used for the test was adjusted by adding dimethyl-silicone oil (the viscosity: 100 cSt, the mercapto-group equivalent: 30000) to mercapto-denatured oil (the viscosity: 100 cSt). A color toner image formed by applying the mixture (1.4 $mg/cm^2$)of yellow toner of 0.7 $mg/cm^2$ and magenta toner of 0.70.7 $mg/cm^2$ on a sheet of printing paper of 82 $g/m^2$ was used to estimate the non-offset band. The initial non-offset band of the silicone oil of each mercapto-group equivalent level was 140–180° C.

The results of the above test are summarized in Table 1.

TABLE 1

| Mercapto-group equivalent | Oil mixture ratio (*2) | Non-offset band after printing 50000 pages | Grade of non-flavor with filter | Grade of non-flavor without filter |
|---|---|---|---|---|
| 30000 | 1:0 | 140–180° C. | 2 | 5 |
| 150000 | 1:4 | 140–180° C. | 1 | 4 |
| 300000 | 1:9 | 140–170° C. | 1 | 3 |
| 1200000 | 1:39 | 140–160° C. | 1 | 2 |
| 3000000 | 1:99 | 140–150° C. | 1 | 1 |
| Dimethyl-oil | 0:100 | 140–145° C. | 1 | 1 |

*2: the weight ratio of mercapto-denatured silicone oil/dimethyl-oil

In Table 1, the grade 1 means that the odor of mercaptan is not sensed at all, the grade 2 means that the odor of mercaptan is very slightly sensed, the grade 3 means that the odor of mercaptan is slightly sensed, but practically matters very little, the grade 4 means that the odor of mercaptan is remarkably sensed, and the grade 5 means that the odor of mercaptan is strongly sensed.

From the above results, it is proved that, without the catalyst filter, the odor of mercaptan can not be reduced to a practical level if the mercapto-group equivalent is not more than at least 300000, and the deodorizing effect of the present invention is remarkable with the use of a catalyst filter because the odor of mercaptan is only slightly sensed even at the mercapto-group equivalent of 30000.

Moreover, from the comparison data concerning the non-offset band after printing 50000 pages, the same releasability as the initial one can be maintained if the mercapto-group equivalent is 150000. However, if the mercapto-group equivalent exceeds 300000, the non-offset band gradually becomes narrower. Therefore, it is necessary to set the mercapto-group equivalent below 300000, preferably to 150000, in order to extend the life of a fixing device. Thus, in accordance with the deodorizing means of the present invention, it is possible to provide a practical electrograph apparatus even though mercapto-denatured silicone oil whose the mercapto-group equivalent is less then 150000 is used, which can maintain the high releasability of a fixing device for a long time and realize long life for the fixing device of an electrograph apparatus.

What is claimed is:

1. An electrograph apparatus comprising a photoconductor; a charging device for uniformly charging a surface of the photoconductor; a developing device; a charge extinguishing device functioning so that a printed paper can be easily released; a fixing device, in which denatured silicone oil having a mercapto-group as a functional group is used as a releasing agent, for fixing a toner image copied on a printing paper, said fixing device being provided above said charging device and said charge extinguishing device; and a deodorizing means provided above said fixing device and comprising a suction fan and a catalyst filter, at least a surface of which has a catalyst of a metal oxide, said deodorizing means promoting reaction of ozone generated at said charging device and said charge extinguishing device with offensive substances containing mercaptan and further decomposing remaining ozone and remaining offensive substances, wherein exhaust gas containing said decomposed ozone and offensive substances is expelled in a direction opposite to a direction of an arrangement of said photoconductor and said developing device.

2. An electrograph apparatus according to claim 1, wherein a flow path of gas to be expelled is provided on a route from said charging device, to said charge extinguishing device, to said fixing device and then to said deodorizing means.

3. An electrograph apparatus according to claim 1, wherein a pressure loss at said catalyst filter during ventilation of the exhaust gas is substantially less than 0.5 mmAq.

4. An electrograph apparatus according to claim 1, wherein said catalyst filter is a honeycomb filter having cells of 100–300 per 1 inch$^2$ with respect to a cross section of said filter.

5. An electrograph apparatus according to claim 1, wherein a flowrate of the exhaust gas in said catalyst filter is such that a temperature in a vicinity of surfaces of said photoconductor and said developing device becomes lower than a glass transition temperature of toner which is used in said electrograph apparatus.

6. An electrograph apparatus according to claim 5, wherein the flowrate of the exhaust gas in said catalyst filter is substantially more than $3\times10^{-3}$ m$^3$/s.

7. An electrograph apparatus according to claim 1, wherein ozone is generated by operating said charging device and said charge extinguishing device periodically also during a stand-by state in which an electrograph function is not performed, and said deodorizing means decomposes both generated ozone and remaining offensive substances containing mercaptan, by promoting reaction of the generated ozone with the remaining offensive substances containing mercaptan.

8. An electrograph apparatus according to claim 1, wherein a baffle plate is provided between said fixing device and said deodorizing means to prevent said fixing device from being over-cooled to a temperature lower than a proper temperature, so that the gas to be expelled flows on routes at both sides of said fixing device.

9. An electrograph apparatus having a fixing device, including a heated roller, for fixing a toner image copied on a printing paper, comprising:

a supply unit for supplying denatured silicone oil, having a mercapto-group as a functional group, as a releasing agent to said heated roller; and deodorizing means, including a suction fan and a catalyst filter, positioned in the vicinity of said fixing device for decomposing offensive substances containing mercaptan which are generated in said fixing device;

wherein at least a surface of said catalyst filter has a catalyst of a metal oxide; and wherein a baffle plate is provided between said fixing device and said deodorizing means to prevent said fixing device from being over-cooled to a temperature lower than a proper temperature so that gas drawn by said fan flows on routes at both sides of said fixing device.

10. An electrograph apparatus according to claim 9, wherein said catalyst filter is a honeycomb filter having cells of 100–300 per 1 inch$^2$ with respect to a cross section of said filter.

11. An electrograph apparatus according to claim 9, wherein a flow rate of exhaust flowing from said fan through said catalyst filter is substantially more than $3\times10^{-3}$ m$^3$/s.

* * * * *